US005518985A

United States Patent [19]

Jahn et al.

[11] Patent Number: 5,518,985

[45] Date of Patent: May 21, 1996

[54] IMAGE RECEIVING MATERIAL FOR THERMAL DYE TRANSFER

[75] Inventors: Reiner Jahn, Müllheim; Horst Westfal, Belm; Jürgen Graumann, Wallenhorst, all of Germany

[73] Assignee: Felix Schoeller jr Papierfabriken GmbH & Co. KG, Osnabrück, Germany

[21] Appl. No.: 406,711

[22] Filed: Mar. 20, 1995

Related U.S. Application Data

[63] Continuation of Ser. No. 180,333, Jan. 12, 1994, abandoned, which is a continuation of Ser. No. 929,315, Aug. 13, 1992, abandoned.

[30] Foreign Application Priority Data

Aug. 14, 1991 [DE] Germany ..... 41 26 864.4

[51] Int. Cl.$^6$ ..... B41M 5/035; B41M 5/38

[52] U.S. Cl. ..... 503/227; 428/195; 428/500; 428/520; 428/522; 428/913; 428/914

[58] Field of Search ..... 8/471; 428/195, 428/913, 914, 500, 520, 522; 503/227; 524/700, 773, 775, 776; 525/191, 222, 227, 228

[56] References Cited

U.S. PATENT DOCUMENTS 5,001,106 3/1991 Egashira et al. ..... 503/227

*Primary Examiner*—Bruce Hess
*Attorney, Agent, or Firm*—Horst M. Kasper

[57] ABSTRACT

An image receiver material for thermal dye transfer comprises a polyolefin-coated base paper and a dye receiving layer applied to and adhering to the front face side of the coated base paper. The dye receiving layer comprises a vinyl chloride/vinyl acetate copolymer with a plasticizer contained in the vinyl chloride/vinyl acetate copolymer and a vinyl chloride copolymer free from plasticizer.

23 Claims, No Drawings

IMAGE RECEIVING MATERIAL FOR THERMAL DYE TRANSFER

This is a continuation of application Ser. No. 08/180,333, filed Jan. 12, 1994, now abandoned, which is a continuation of application Ser. No. 07/929,315, filed Aug. 13, 1992, now abandoned.

BACKGROUND OF THE INVENTION

1. Field of the Invention

The invention relates to an image receiving material for dye diffusion thermal transfer providing a thermal dye transfer as well as to a method for the production of such image receiving material. 2. Brief Description of the Background of the Invention Including Prior Art The system of thermal dye transfer or dye diffusion thermal transfer, abbreviated "D2T2", developed in recent years, allows the reproduction of an electronically generated image in the form of a hard copy.

The principle of the thermal dye transfer comprises that the digital image is prepared with respect to the base colors: cyan, magenta, yellow, and black, and is transformed into corresponding electrical signals. These signals are transformed to a thermal printer and are converted into thermal energy. Based on thermal heating effect, the dye sublimes from the donor layer of an ink ribbon or an inked sheet, contacting the receiving material, and diffuses into the receiving layer.

A receiving material for thermal dye transfer comprises in general a support substrate with a receiving layer placed onto the front side of the support substrate. Frequently, other layers are also applied to the front side of the support substrate in addition to the receiving layer. Such layers include, for example, a barrier layer, a separating layer, an adhesion layer, and a protective layer.

Support substrates can be plastic foils such as, for example, polyester foil or a resin-coated paper.

The receiving layer comprises in general a thermoplastic resin as a main component, where the thermoplastic resin exhibits an affinity to the dye of the inked ribbon. Such thermoplastic resins include linear polyesters, for example, polyethylene terephthalate, polybutylene terephthalate, or acrylic resins, for example, polymethyl methacrylate, polybutyl methacrylate, polymethyl acrylate, etc. In addition, polystyrene, polycarbonate, polyvinyl pyrrolidone, ethyl cellulose, polysulphones, or other plastic materials can be employed as dye accepting resins.

The following requirements are imposed on the receiving material for the thermotransfer.

A surface smoothness is required.

A stability to deformation by heat/pressure is required.

Print stability, i.e., a uniform print appearance (no blurs or mat spots) is required.

A stability to light is required and no tendency to yellowing can be permitted.

A good dye solubility is required.

A good resistance to scratching and abrasion is required.

Anti-blocking properties are required and sticking together of receiving material is not permissible.

In order to meet these requirements, several different paths have been taken.

It is known from the U.S. Pat. No. 4,748,150 and from the U.S. Pat. No. 4,774,224 to apply a receiving layer made of polycarbonate onto a polyethylene-coated base paper. In addition, a subbing layer is applied between the support substrate and the receiving layer. The subbing layer, comprising a vinylidene chloride copolymer, is furnished to improve the adhesion of the receiving layer on the support substrate material.

It is a disadvantage of this receiving sheet that the polycarbonate, employed according to U.S. Pat. Nos. 4,748,150 and 4,774,224 tends very strongly to yellow and that this influences negatively the transferred picture in the course of time. A further disadvantage is associated with the situation that both layers (subbing and receiving layer) are applied from an organic solvent phase, which raises problems and questions relative to health and safety issues.

The problem of the stability against light impingement was intended to be solved according to the U.S. Pat. No. 4,775,657 by applying a protective layer of polyester or polyurethane onto a receiving layer formed of polycarbonate. It is a disadvantage of this method that the print stability of the receiving sheet, produced in this manner, is relatively low and that this method is associated with the application of the layers from organic solvent phases.

The European Patent Application EP-0,261,970 describes a good heat resistance of the receiving sheet and a good anti-blocking properties of the receiving layer. For this purpose, a single layer is recommended, which comprises in addition to a linear saturated polyester as binder also a silane copolymer coupled with silica as a separating agent.

The Japanese Printed Patent document JP 0,270,487 claims a receiving layer comprising vinyl chloride/vinyl acetate copolymer as binder, where the receiving layer is to assure a high density of the transferred picture image and wherein additionally good anti-blocking properties are to be achieved based on the incorporation of silicone oil into this layer. It is a disadvantage of this receiving material that there is a poor line sharpness of the transferred image and that the layer is applied from a solvent phase.

SUMMARY OF THE INVENTION

1. Purposes of the Invention

It is an object of the present invention to furnish an image receiving material for thermal dye transfer methods, which is free of the disadvantages associated with image receiving materials of the art.

It is another object of the present invention to provide an image receiving material which has a receiving layer, which can be applied without involvement of an organic solvent in the application phase.

It is yet another object of the present invention to provide an image receiving material which exhibits a high stability relative to light impingement and does not show tendencies to yellowing.

It is another object of the present invention to provide a receiving material which is not easily deformed by heat and pressure, and which exhibits good sheet flatness and good anti-blocking properties.

It is yet another object of the present invention to provide a receiving material which has a very good color density and a good line sharpness of the reproduced images.

These and other objects and advantages of the present invention will become evident from the description which follows.

2. Brief Description of the Invention

According to the present invention there is provided for an image receiving material for thermal dye transfer. A resin-coated base paper has a front side. A dye receiving layer is applied to and adheres to the front side of the base paper. The dye receiving layer comprises a vinyl chloride/vinyl acetate copolymer with a plasticizer contained in the vinyl chloride/vinyl acetate copolymer. The dye receiving layer comprises a vinyl chloride copolymer free from a plasticizer. The weight ratio of vinyl chloride/vinyl acetate copolymer with the plasticizer contained in the vinyl chloride/vinyl acetate copolymer to the vinyl chloride copolymer free from plasticizer amounts to from about 90:10 to 30:70 parts by weight.

The plasticizer, contained in the vinyl chloride/vinyl acetate copolymer can be phthalic acid ester. The plasticizer can be dibutyl phthalate. The amount of the plasticizer can amount to from about 1 to 45 weight-percent relative to the dry weight of the dye-receiving layer. The amount of the plasticizer preferably can amount from about 2 to 23 weight-percent relative to the dry weight of the dye-receiving layer.

The vinyl chloride copolymer free from plasticizer can be a vinyl chloride/methacrylic acid ester polymerization product, preferably a vinyl chloride/acrylic acid methyl ester copolymer. The vinyl chloride copolymer free from plasticizer can be a vinyl chloride/acrylic acid ester/methacrylic acid ester polymerization product. The vinyl chloride copolymer free from plasticizer can be a mixture of a vinyl chloride/acrylic acid ester polymerization product, a vinyl chloride/methacrylic acid ester polymerization product, and a vinyl chloride/acrylic acid ester/methacrylic acid ester polymerization product.

The ratio of vinyl chloride/vinyl acetate copolymer with a plasticizer to the vinyl chloride copolymer free from plasticizer preferably amounts to from about 70:30 to 40:60 parts by weight. The dry weight of the coating of the dye receiving layer can amount to from about 0.3 to 15 g/m$^2$. The coating weight of the dye receiving layer preferably amounts to from about 1 to 10 g/m2. The dye receiving layer can include a member of the group consisting of matting agents, wetting agents, separating agents and mixtures thereof. A separating layer can be applied to the face of the dye receiving layer in an amount from 0.1 to 1 g/m$^2$ relative to the dried layer. The separating layer is preferably applied to the dye receiving layer in an amount from about 0.4 to 0.8 g/m$^2$ relative to the dried layer. The separating layer can comprise a member of the group consisting of silicon oil, cross-linked polysiloxane, a low-molecular polyethylene and mixtures thereof.

According to the present invention there is further provided for a method for producing an image receiving material for thermal dye transfer with a dye receiving layer. A dye receiving coating containing a combination of a vinyl chloride/vinyl acetate copolymer with a plasticizer contained in the vinyl chloride/vinyl acetate copolymer and a vinyl chloride copolymer free from plasticizer from an aqueous phase is applied to a front face of a polyethylene-coated base paper. The coating weight of a polyethylene coating of the polyethylene-coated paper is at least about 5 g/m$^2$.

A separating layer from an aqueous phase can be applied onto the receiving layer in an amount of from about 0.1 to 1 g/m$^2$ and preferably in an amount of from 0.4 to 0.8 g/m$^2$ onto the receiving layer.

An image receiving material for thermal dye transfer comprises a resin-coated base paper and a dye receiving layer, applied to the front side of the base paper. The dye receiving layer comprises a combination of a vinyl chloride/vinyl acetate copolymer with a plasticizer vinyl chloride copolymer free from plasticizer.

The plasticizer, contained in the vinyl chloride/vinyl acetate copolymer is phthalic acid ester, in particular dibutyl phthalate. The amount of the plasticizer contained in the vinyl chloride/vinyl acetate copolymer can amount from about 1 to 45 weight-percent relative to the dry weight of the layer, preferably from about 2 to 23 weight percent. The vinyl chloride copolymer free from plasticizer is a vinyl chloride/(meth)acrylic acid ester polymerization product. The weight ratio of vinyl chloride/vinyl acetate copolymer with a plasticizer to the vinyl chloride copolymer free from plasticizer can amount to from about 90:10 to 30:70 parts by weight. The dry weight of the coating of the dye receiving layer can amount to from about 0.3 to 15 g/m$^2$. The dye receiving layer can include matting agents, wetting agents, separating agents and other additives. The dye receiving layer can also include pigments. A separating layer can be applied to the dye receiving layer in an amount from 0.1 to 1 g/m$^2$. The separating layer can comprise a member selected from the group consisting of silicon oil, cross-linked polysiloxane, a low-molecular polyethylene or mixtures thereof.

The method of the production of an image receiving material for thermal dye transfer with a dye receiving layer comprises a dye receiving resin and is applied to the front face of a resin-coated base paper. The receiving layer contains a combination of a vinyl chloride/vinyl acetate copolymer with a plasticizer and of a vinyl chloride copolymer free from plasticizer and is applied as the dye receiving resin from an aqueous phase onto the front face side of a polyethylene-coated base paper. The coating weight of the polyethylene coating is at least 5 g/m$^2$.

A separating layer from an aqueous phase in an amount of from about 0.1 to 1 g/m$^2$ can be applied onto the receiving layer.

The novel features which are considered as characteristic for the invention are set forth in the appended claims. The invention itself, however, both as to its method of operation, its products and physical requirements, together with additional objects and advantages thereof, will be best understood from the following description of specific embodiments and examples.

DESCRIPTION OF INVENTION AND PREFERRED EMBODIMENT

The present invention provides that a dye receiving layer is applied to the front face of a polyolefine coated base paper. The dye receiving layer includes a vinyl chloride/vinyl acetate copolymer and a vinyl chloride free from plasticizer.

Surprisingly, it has been found that the use of the above recited combination generates a receiving sheet which meets not only the initially recited requirements but which, in addition, allows a high color density of the transferred image while at the same time the gradation of color shades and the line sharpness are increased.

According to a preferred embodiment of the invention, a vinyl chloride/vinyl acetate copolymer with a plasticizer selected from phthalic acid ester, in particular dibutyl phthalate is used. Also other compatible plasticizers such as, for example, trimellitic acid esters can be used.

A vinyl chloride/-(meth)acrylic acid ester copolymerization product is employed as a vinyl chloride copolymer free from plasticizer, and in particular a vinyl chloride/acrylic acid methyl ester copolymerization product is used. The vinyl chloride/(meth) acrylic ester copolymerization product can be a vinylchloride acrylic acid ester copolymer, a vinyl chloride methacrylic ester copolymer or a mixture thereof.

The ratio of vinyl chloride/vinyl acetate copolymer with a plasticizer to vinyl chloride copolymer free from plasticizer amounts to from about 90:10 to 30:70 by weight, and particular from about 70:30 to 40:60 by weight, according to the invention composition.

The content of plasticizer in vinyl chloride/vinyl acetate copolymer amounts to from about 1 to 45 weight percent, relative to the dry weight of the layer, and in particular to from about 2 to 23 weight percent.

The dye receiving layer for the invention receiving material can additionally contain matting agents and pastes, wetting agents, separating agents, and other additives. The dye receiving layer can also contain pigments.

The additives and agents can be further defined as follows. The pigments can be inorganic or organic, colored or white coloring pigments. Inorganic pigments can include for example white pigments, such as titanium dioxide ($TiO_2$), and colored pigments, such as cobalt blue and ultramarine. Organic pigments can include, for example, azo pigments or quinacridone pigments.

The separating agents can reduce the adhesion forces between two adjoining surfaces. These separating agents can include, for example, silicone oil, waxes, metallic soaps, polysiloxane, or fluorine compounds.

The matting agents, such as for example silicon dioxide $SiO_2$ or plastic dispersions, can effect the matting of the layer.

Dispersion auxiliary agents, which can be organic or inorganic, monomeric or polymeric substances, facilitate the dispersion of particles in a dispersion agent based on a reduction of the interfacial tension between the two components. Such agents can include for example polyphosphates, alkali phosphoric silicates, or phenol(naphthalene-)sulfonic acid/formaldehyde condensation products.

According to a preferred embodiment of the invention, a separating layer in an amount of 0.1 to 1 g/m2, and in particular in an amount of 0.4 to 0.8 g/m$^2$, can be applied onto the receiving layer. The separating layer can comprise a silicone oil, a cross-linked polysiloxane, or a low-molecular polyethylene.

The separating layer is applied in the form of an aqueous emulsion, in an amount of 5–40 weight percent relative to water, onto the receiving material with an application weight of 0.5 g/square meter and is dried. Following drying, this layer consists substantially 100% of silicone oil, polyethylene wax or cross-linked polysiloxane. No other additives are contained in the dry separating layer.

The dye receiving layer, employed as an aqueous dispersion, can be applied with the aid of all conventionally employed application methods, spreading methods, coating methods, and metering methods such as, for example, roll coating methods, nip coating methods, engraving methods, as well as air brushing or blade knife metering onto a support substrate such as, for example, a coated or uncoated paper.

The coating weight of the dye receiving layer amounts to 0.3 to 15 g/m$^2$, and is preferably from about 1 to 10 g/m$^2$.

A paper coated on at least one side with polyolefine, for example, polyethylene, is preferably employed as a support substrate, wherein the polyolefine layer exhibits a coating weight of at least 5 g/m$^2$. The polyolefine layer can comprise pigments such as, for example, titanium dioxide in its rutile or anatase modification and other additives. The following examples further illustrate the invention.

EXAMPLE 1

A base paper which was coated on two sides with polyethylene served as a support substrate with a basis weight of 180 g/m$^2$. The back side of the base paper was coated with clear polyethylene, where the clear polyethylene is a mixture of low-density polyethylene LDPE and high-density polyethylene HDPE (55% high-density polyethylene HDPE and 45% low-density polyethylene LDPE). The polyethylene coating weight was 15 g/m$^2$.

The front side was coated with pigmented polyethylene mixture containing

20% LDPE where d=0.934 g/cm$^3$, melt-flow index (MFI)=3.0

17% LDPE where d=0.924 g/cm$^3$, melt-flow index (MFI)=4.5

43% HDPE where d=0.959 g/cm$^3$, melt-flow index (MFI)=8.0

20% Masterbatch with 50% titanium dioxide $TiO_2$ in an application amount of 12 g/m$^2$.

The front side of the polyethylene-coated base paper was coated with an aqueous dispersion of the following composition.

COMPOSITION TABLE 1

| | Composition, weight-percent | | | | |
|---|---|---|---|---|---|
| Product | 1a | 1b | 1c | 1d | 1e |
| vinyl chloride/vinyl acetate copolymer (25 weight-% plasticizer relative to resin) 50 weight-% in water (Vinnol 50/25C, supplied by Wacker Corporation Munich, Germany) | 80 | 70 | 50 | 50 | 40 |
| vinyl chloride/acrylic acid methyl ester copolymerization product (free from plasticizer) 50 weight-% in water Lutofan 100 D, BASF Corporation, Ludwigshafen, Germany | 20 | 30 | 50 | 50 | 60 |
| coating weight, g/m$^2$ | 5 | 0.5 | 5 | 10 | 5 |
| Other conditions of the experiment: | | | | | |
| machine advance speed: | 130 m/min | | | | |
| Drying temperature: | 110° C. | | | | |
| Drying time: | 10 sec | | | | |

The resulting receiving material was printed by applying the thermal image transfer method and was subsequently analyzed. The results are listed in Table 1.

EXAMPLE 2

The polyethylene-coated base paper of Example 1 was coated with an aqueous dispersion of the following composition:

COMPOSITION TABLE 2

| | Composition, weight-percent | | |
|---|---|---|---|
| Product | 2a | 2b | 2c |
| vinyl chloride/vinyl acetate copolymer (5 weight-% plasticizer relative to resin) | 50 | — | — |

COMPOSITION TABLE 2-continued

| Product | Composition, weight-percent 2a | 2b | 2c |
|---|---|---|---|
| 50 weight-% in water vinyl chloride/vinyl acetate copolymer (15 weight-% plasticizer relative to resin) 50 weight-% in water | — | 50 | — |
| vinyl chloride/vinyl acetate copolymer (25 weight-% plasticizer relative to resin) 50 weight-% in water | — | — | 50 |
| vinyl chloride/acrylic acid methyl ester copolymerization product (free from plasticizer) 50 weight-% in water | 50 | 50 | 50 |
| coating weight, g/m$^2$ | 5 | 5 | 5 |

The resulting receiving material was printed using the thermal image transfer method and was subsequently analyzed. The results are listed in Table 2.

EXAMPLE 3

The polyethylene-coated base paper according to Example 1 was coated with an aqueous dispersion of the following composition:

COMPOSITION TABLE 3

| Product | Composition, weight-percent 2a | 2b | 2c |
|---|---|---|---|
| vinyl chloride/vinyl acetate copolymer (25 weight-% plasticizer relative to resin) 50 weight-% in water | 49.5 | 49.5 | 70.0 |
| vinyl chloride/acrylic acid methyl ester copolymerization product (free from plasticizer) 50 weight-% in water | 49.5 | 49.5 | 29.0 |
| polytetrafluoroethylene (separating agent) 30 weight-% in water | 1.0 | 2.0 | 1.0 |
| coating weight, g/m$^2$ | 5 | 10 | 5 |

The resulting receiving material was printed by applying the thermal image transfer method and was subsequently analyzed. The results are listed in Table 3.

EXAMPLE 4

The receiving material according to the Example 1, Composition 1c, was coated with an aqueous emulsion and subsequently dried. The coating weight of the separating layer obtained in this manner amounted to 0.5 g/m$^2$.

COMPOSITION TABLE 4

| | |
|---|---|
| 4a | silicone oil, Baysilone N, Bayer AG, Leverkusen, Germany, 38 weight-% in water |
| 4b | low-molecular polyethylene, EPD 191, Hoechst Corp., Frankfurt, Germany, 35 weight-% in water |

The resulting receiving material was printed under application of the thermal image transfer method and was subsequently analyzed. The results are listed in Table 3.

COMPARISON EXAMPLE V1

A polyethylene-coated base paper as in Example 1 was coated with an aqueous dispersion of the following composition:

COMPOSITION TABLE 5

| Product | Composition, weight-percent V1a | V1b |
|---|---|---|
| vinyl chloride/vinyl acetate copolymer (25 weight-% plasticizer relative to resin) 50 weight-% in water | 100 | — |
| vinyl chloride/vinyl acetate copolymer (without plasticizer) 50 weight-% in water | — | 50 |
| vinyl chloride/acrylic acid methyl ester copolymerization product (free from plasticizer) 50 weight-% in water | — | 50 |
| Coating weight, g/m$^2$ | 10 | 10 |

The receiving material obtained after a drying process was printed using the thermal image transfer method and was subsequently analyzed. The results are listed in Table 4.

COMPARISON EXAMPLE V2

A commercially available image receiving sheet of the Hitachi Corporation, Japan, was used as a comparison. The results are stated in Table 4.

Testing of the Image Receiving Material Obtained according to the Examples and Comparison Examples The image receiving material according to the invention was subjected to a thermal image transfer process. For this process, a Color Video Printer VY-25 E of the Hitachi Corporation, Japan, was employed under use of a Hitachi inked ribbon. The video printer had the following technical data:

image storage: PAL system 1 storage for one complete picture image print image: 64 color hue image picture elements 540:620 dots printing time: two minutes/picture image.

The color density, the anti-blocking properties, and the sharpness of the lines were investigated in the received printed picture images, i.e. the hard copy.

The density measurements were performed before and after submitting the picture images to a 24-hour exposure with a Xenon lamp.

The apparatus employed for this purpose was an original reflection densitometer SOS-45. The measurements were performed for the base colors: cyan, magenta, yellow and black. The number of possible color gradations of color shades from 0 to 7 is also presented in the Tables.

The sharpness of the lines was determined by way of test picture images printed in the base colors. The test picture image shows straight lines, which are printed both in a horizontal as well as in a vertical direction. The measurement was performed with a thread counter at three measurement positions. The arithmetic average was calculated from the measurements. The smaller the measured value of the line width, the higher was the sharpness of the picture.

At the same time comparison measurements were performed with commercially available receiving materials.

The results listed in Tables 1 through 4 show that print images with a high color density and a high gradation of color shades are obtained with the image receiving material produced according to the invention, while simultaneously a good line sharpness is obtained. The printed pictures, produced according to the present invention, exhibit improved values also with respect to stability against light relative to the data obtained for the comparison materials.

It will be understood that each of the steps, conditions and reagents described above, or two or more together, may also find a useful application in other types of materials for dye transfer differing from the types described above.

While the invention has been illustrated and described as embodied in the context of an image receiving material for thermal dye transfer and a method for the production of said image receiving material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An image receiving material for thermal dye transfer comprising a resin-coated base paper having a front side;

a dye receiving layer applied to and adhering to the front side of the resin-coated base paper, wherein the dye receiving layer comprises a vinyl chloride/vinyl acetate copolymer containing a plasticizer that has been added during the polymerization of said vinyl chloride/vinyl acetate copolymer, and a vinyl chloride copolymer free from plasticizer, wherein the weight ratio of vinyl chloride/vinyl acetate copolymer with the plasticizer contained in the vinyl chloride/vinyl acetate copolymer to the vinyl chloride copolymer free from plasticizer amounts to from about 90:10 to 30:70 parts by weight.

2. The image receiving material according to claim 1, wherein the plasticizer, contained in the vinyl chloride/vinyl acetate copolymer, is phthalic acid ester.

3. The image receiving material according to claim 1, wherein the plasticizer, contained in the vinyl chloride/vinyl acetate copolymer, is dibutyl phthalate.

4. The image receiving material according to claim 1, wherein the amount of the plasticizer, contained in the vinyl chloride/vinyl acetate copolymer, amounts to from about 1 to 45 weight-percent relative to the dry weight of the dye-receiving layer.

5. The image receiving material according to claim 1, wherein the amount of the plasticizer, contained in the vinyl chloride/vinyl acetate copolymer, amounts from about 2 to 23 weight-percent relative to the dry weight of the dye-receiving layer.

6. The image receiving material according to claim 1, wherein the vinyl chloride copolymer free from plasticizer is a vinyl chloride/acrylic acid methyl ester polymerization product.

7. The image receiving material according to claim 1, wherein the vinyl chloride copolymer free from plasticizer is a vinyl chloride/acrylic acid ester polymerization product.

8. The image receiving material according to claim 1, wherein the vinyl chloride copolymer free from plasticizer is a vinyl chloride/(meth)acrylic acid ester polymerization product.

9. The image receiving material according to claim 1, wherein the vinyl chloride copolymer free from plasticizer is a vinyl chloride/acrylic acid ester/(meth)acrylic acid ester polymerization product.

10. The image receiving material according to claim 1, wherein the vinyl chloride copolymer free from plasticizer is a mixture of a vinyl chloride/acrylic acid ester polymerization product, a vinyl chloride/(meth)acrylic acid ester polymerization product, and a vinyl chloride/acrylic acid ester/(meth)acrylic acid ester polymerization product.

11. The image receiving material according to claim 1, wherein the ratio of vinyl chloride/vinyl acetate copolymer with plasticizer contained in the vinyl chloride/vinyl acetate copolymer to the vinyl chloride copolymer free from plasticizer amounts to from about 70:30 to 40:60 parts by weight.

12. The image receiving material according to claim 1, wherein the dry weight of the coating of the dye receiving layer amounts to from about 0.3 to 15 $g/m^2$.

13. The image receiving material according to claim 1, wherein the dry weight of the coating of the dye receiving layer amounts to from about 1 to 10 $g/m^2$.

14. The image receiving material according to claim 1, wherein the dye receiving layer includes a member of the group consisting of matting agents, wetting agents, separating agents and mixtures thereof.

15. The image receiving material according to claim 1 further comprising a separating layer applied on the dye receiving layer in an amount from 0.1 to 1 $g/m^2$ relative to the dried layer.

16. The image receiving material according to claim 15, wherein the separating layer is applied to the dye receiver layer in an amount from about 0.4 to 0.8 $g/m^2$ relative to the dried layer.

17. The image receiving material according to claim 15, wherein the separating layer comprises a member of the group consisting of silicone oil, cross-linked polysiloxane, a low-molecular polyethylene and mixtures thereof.

18. An image receiving material for thermal dye transfer comprising a resin-coated base paper and a dye receiving layer, applied to the front side of the resin-coated base paper, wherein the dye receiving layer comprises a vinyl chloride/vinyl acetate copolymer containing a plasticizer that has been added during the polymerization of said chloride/vinyl acetate copolymer and a vinyl chloride copolymer free from plasticizer.

19. The image receiving material according to claim 18, wherein the plasticizer, contained in the vinyl chloride/vinyl acetate copolymer, is a phthalic acid ester;

wherein the amount of the plasticizer contained in the vinyl chloride/vinyl acetate copolymer amounts from about 1 to 45 weight-percent relative to the dry weight of the layer;

wherein the vinyl chloride copolymer free from plasticizer is a vinyl chloride/(meth) acrylic acid ester polymerization product;

wherein the weight ratio of vinyl chloride/vinyl acetate copolymer with plasticizer contained in the vinyl chloride/vinyl acetate copolymer to the vinyl chloride copolymer free from plasticizer amounts to from about 90:10 to 30:70 parts by weight;

wherein the dry weight of the coating of the dye receiving layer amounts to from about 0.3 to 15 $g/m^2$;

wherein the dye receiving layer includes matting agents, wetting agents, separating agents and other additives;

wherein a separating layer is applied to the dye receiving layer in an amount from 0.1 to 1 $g/m^2$;

wherein the separating layer comprises a member selected from the group consisting of silicone oil, cross-linked polysiloxane, a low-molecular polyethylene and mixtures thereof.

20. The image receiving material according to claim 18, wherein the phthalic acid ester is dibutyl phthalate.

21. The image receiving material according to claim 1, wherein the dye receiving layer includes pigments.

22. An image receiving material for thermal dye transfer comprising a resin-coated base paper having a front side;

a dye receiving layer applied to and adhering to the front side of the resin-coated base paper, wherein the dye receiving layer comprises a coating of a vinyl chloride/vinyl acetate copolymer with a plasticizer contained in the vinyl chloride/vinyl acetate copolymer, and a vinyl chloride copolymer free from plasticizer, wherein the weight ratio of the vinyl chloride/vinyl acetate copolymer with the plasticizer contained in the vinyl chloride/vinyl acetate copolymer to the vinyl chloride copolymer and free from plasticizer amounts to from about 90:10 to 30:70 parts by weight.

23. An image-receiving material for thermal dye transfer comprising a resin-coated base paper having a front side;

a dye-receiving layer applied from an aqueous dispersion to the front side of the resin-coated base paper, wherein the dye-receiving layer comprises a vinyl chloride/vinyl acetate copolymer with a plasticizer that has been added during the polymerization of said vinyl chloride/vinyl acetate copolymer and a vinyl chloride/acrylic acid methyl ester copolymer, wherein the weight ratio of the vinyl chloride/vinyl acetate copolymer with the plasticizer contained in the vinyl chloride/vinyl acetate copolymer to the vinyl chloride/acrylic acid methyl ester copolymer amounts to from about 90:10 to 30:70 parts by weight, wherein the amount of the plasticizer contained in the vinyl chloride/vinyl acetate copolymer amounts to from about 1 to 45 parts by weight related to the dry weight of the dye-receiving layer.

* * * * *